United States Patent [19]

Thomas et al.

[11] Patent Number: 4,613,385

[45] Date of Patent: Sep. 23, 1986

[54] HIGH STRENGTH, LOW CARBON, DUAL PHASE STEEL RODS AND WIRES AND PROCESS FOR MAKING SAME

[75] Inventors: Gareth Thomas, Berkeley; Alvin H. Nakagawa, Campbell, both of Calif.

[73] Assignee: Regents of the University of California, Berkeley, Calif.

[21] Appl. No.: 638,130

[22] PCT Filed: Dec. 9, 1982

[86] PCT No.: PCT/US84/01722

§ 371 Date: Aug. 6, 1984

§ 102(e) Date: Aug. 6, 1984

[51] Int. Cl.[4] ..... C21D 9/52

[52] U.S. Cl. ..... 148/12 B; 148/12.3; 148/12.4; 148/320; 148/337

[58] Field of Search ..... 148/12 B, 12 F, 12.4, 148/144, 36, 12.3; 75/123 L

[56] References Cited

U.S. PATENT DOCUMENTS

| | | | |
|---|---|---|---|
| 3,423,252 | 1/1969 | Grange | 148/12 R |
| 4,067,756 | 1/1978 | Koo et al. | 148/36 |
| 4,088,511 | 5/1978 | Rowney | 148/12.4 |
| 4,108,695 | 8/1978 | Paulitsch et al. | 148/12 B |
| 4,325,751 | 4/1982 | Josefsson | 148/12 F |
| 4,406,713 | 9/1983 | Yutori et al. | 148/12 B |

FOREIGN PATENT DOCUMENTS

| | | | |
|---|---|---|---|
| 58016 | 8/1982 | European Pat. Off. | 148/12 B |
| 35118 | 3/1977 | Japan | 148/12 B |
| 19737 | 9/1981 | Japan | 148/12 F |

OTHER PUBLICATIONS

Koo et al., "Design of Duplex Fe/X/0.1C Stals for Improved Mechanical Properties", Metallurgical Transactions, vol. 8A, Mar. 1977, pp. 525–528.

Iron Age, "Steel Bars Climb to 400,000 Psi", Feb. 1963, pp. 85–87.

*Primary Examiner*—Wayland Stallard

*Attorney, Agent, or Firm*—Flehr, Hohbach, Test, Albritton & Herbert

[57] ABSTRACT

A high strength, high ductility, low carbon, dual phase steel wire, bar or rod and process for making the same is provided. The steel wire, bar or rod is produced by cold drawing to the desired diameter in a single multipass operation a low carbon steel composition characterized by a duplex microstructure consisting essentially of a strong second phase dispersed in a soft ferrite matrix with a microstructure and morphology having sufficient cold formability to allow reductions in cross-sectional area of up to about 99.9%. Tensile strengths of at least 120 ksi to over 400 ksi may be obtained.

14 Claims, 3 Drawing Figures

HIGH STRENGTH, LOW CARBON, DUAL PHASE STEEL RODS AND WIRES AND PROCESS FOR MAKING SAME

The present invention is directed to a process for making high-strength, high-ductility, low-carbon steel wires, bars and rods by cold drawing dual-phase steels. Here, the term "dual-phase steels" refers to a class of steels which are processed by continuous annealing, bach annealing, or conventional hot rolling to obtain a ferrite matrix with a dispersed second phase such as martensite, bainite and/or retained austenite. The second phase is controlled to be a strong, tough and deformable phase unlike the hard, non-deformable carbide phase found in pearlitic rods and wires. It must be suitably dispersed and in sufficient volume fraction i.e. greater than 10%, to provide a substantial contribution to the strength in the as-heat-treated condition and to increase the work-hardening rate during wire drawing. Various heat treatment paths can be used to develop the dual-phase microstructure and the morphology depends on the particular heat treatment employed. A preferred heat treatment is the intermediate quench method i.e. austenitize and quench to 100% martensite prior to annealing in the two phase $\alpha+\gamma$ field and quenching to a ferrite martensite structure. The invention is further directed to the high-structure, high ductility steel wires, bars and rods produced by the process of the present invention.

Steel wire has many known uses, such as for making cables, chains, and springs. It is also used to make steel belts and bead wire for tires, and steel strands are included in multistrand electrical wire to improve the tensile strength of the wire. In these applications, the diameter requirements range from 0.005 inch to more than 0.25 inch with strength requirements ranging from 250 ksi to as much as 400 ksi in the smaller diameters. In all of these applications, it is important to provide a steel wire having a high tensile strength and good ductility at the required diameter.

The oldest and most common method of producing high strength, high ductility wire is by patenting a near eutectoid composition pearlitic steel. However, this process is complex and expensive. A further disadvantage of the patenting method is an inherent limitation in the maximum wire diameter that can be produced at a given strength level.

There is a need for steel wire and rods having higher tensile strength and higher ductility than steel wire and rods produced by the known methods, as well as a more economical method for producing high strength steel wire and rods. The present invention would replace the conventional method of patenting pearlitic steel to produce wwire with a process whereby an alloy of relatively simple composition is cold drawn into wire or rods in a single multipass operation, i.e., without intermediate annealing or patenting heat treatments. Elimination of the patenting heat treatments in the production of high strength steel wire should lower the cost of producing high strength steel wire, especially in light of the present fuel situation.

The cold drawing process requires a low alloy steel composition with a microstructure and morphology which provides high initial strength, high ductility, rapid work hardening, and good cold formability. The steel should be capable of being cold drawn, without intermediate anneals or patenting heat treatments, to the desired diameter, tensile strength, and ductility.

A specific group of steels with a chemical composition specifically developed to impart higher mechanical property values is known in the art as high-strength, low-alloy (HSLA) steel. These steels contain carbon as a strengthening element in an amount reasonably consistent with weldability and ductility. Various levels and types of alloy carbide formers are added to achieve the mechanical properties which characterize these steels. However, the high tensile strength and high ductility needed in many applications for steel wire and rods do not seem to be attainable using HSLA steels.

The factors governing the properties of low carbon steels are primarily its carbon content and microstructure, and secondarily the residual alloy. Commonly, low carbon steels contain silicon, manganese, or a combination of silicon and manganese. In addition, carbide forming elements such as, vanadium, chromium, niobium, molybdenum may be added.

Low carbon, dual-phase microstructured steels characterized by a strong second phase dispersed in a soft ferrite matrix show potential for satisfying the tensile strength, ductility, flexibility and diameter requirements of high strength steel wire. Furthermore, they have potential for achieving a level of cold formability which allows cold drawing without patenting or intermediate heating. In particular, a low carbon, duplex ferrite-martensite steel, disclosed in U.S. Pat. No. 4,067,756 issued Jan. 10, 1978, is of interest in the present invention because it has high strength, high ductility characteristics and is composed of inexpensive elements. However, as generally fabricated, it has a tensile strength of about 120 ksi which is much lower than the tensile strength required for most applications of high strength steel wire. The process of the present invention is directed to producing a high-strength steel wire having a tensile strength of at least about 120 ksi. A preferred tensile strength range is 120 ksi to 390 ksi, but strengths above 400 ksi may be achieved.

It is therefore an object of the present invention to provide an improved process for making high strength, high ductility steel wires and rods and to produce steel wires or rods with increased tensile strength, ductility, and flexibility at the desired diameter.

Another object of the present invention is to provide a process for making high strength, high ductility steel wires or rods comprising the step of cold drawing a dual-phase steel composition to the required strength and ductility without intermediate anneals or patenting heat treatments, thereby providing complete flexibility in choosing the wire diameter.

It is another object of the present invention to provide a process for making high strength, high ductility steel wires or rods that eliminates the intermediate patenting step used in the present process for making pearlitic steel wire, thereby reducing the complexity, cost, and energy consumption of the process for making high strength steel wires and rods.

A further object of the present invention is to provide a process for making high strength steel wires and rods which is versatile, allowing for a wide range of diameters, strength, and ductility properties in the final steel wire or rod based on the choice of the initial duplex microstructure and manipulation of the microstructure through appropriate thermal processing.

A further object of the present invention is to provide high strength, high ductility steel wires or rods which have a tensile strength at least about 120 ksi.

Additional objects and advantages of the present invention will become evident from the following description taken in conjunction with the accompanying drawings.

In general, the present invention is directed to high strength, high ductility, low carbon steel wires or rods and the process for making the same. The process involves cold drawing a low carbon dual-phase steel to the desired diameter in a single multipass operation. The steel is characterized by a duplex microstructure consisting essentially of a strong second phase dispersed in a soft ferrite matrix and a microstructure and morphology having sufficient cold formability to allow reductions in cross-sectional area of up to about 99.9%.

One preferred embodiment of the invention is a high strength, high ductility, low carbon steel rod or wire produced from a steel composition characterized by an appropriate duplex ferrite-martensite microstructure, for example as shown in FIG. 1, and the process for making the same. The process involves cold drawing the duplex ferrite-martensite steel to the desired diameter in a single multipass operation. In high strength steels with a duplex ferrite-martensite microstructure, the strong, deformable second phase consists predominately of martensite but may contain bainite and retained austenite. The strong second phase is dispersed in a soft ductile ferrite matrix; the martensite provides the strength in the composite whereas the ferrite provides the ductility.

According to the present invention, the high strength, high ductility steel wires or rods are produced by a process whereby a low carbon steel composition, characterized by a duplex microstructure consisting essentially of a strong second phase dispersed in a soft ferrite matrix, is cold drawn to the desired diameter in a single multipass operation. The starting steel composition prior to the cold drawing should possess a duplex microstructure and a morphology which are sufficient to provide a level of cold formability allowing reductions in cross-sectional area of up to 99.9% during cold drawing.

The process of the invention provides an advantage over known processes in that it eliminates the intermediate heat treatments or patenting steps used in the known process for making pearlitic steel wire, and thereby reduces the complexity, cost, and energy consumption of the process. Furthermore, a wider range of rod and wire diameter sizes can be produced by the process of the invention than in the patenting method. In the patenting method, there is an inherent limitation in the maximum wire diameter that can be produced at a given strength level.

Figure 3:
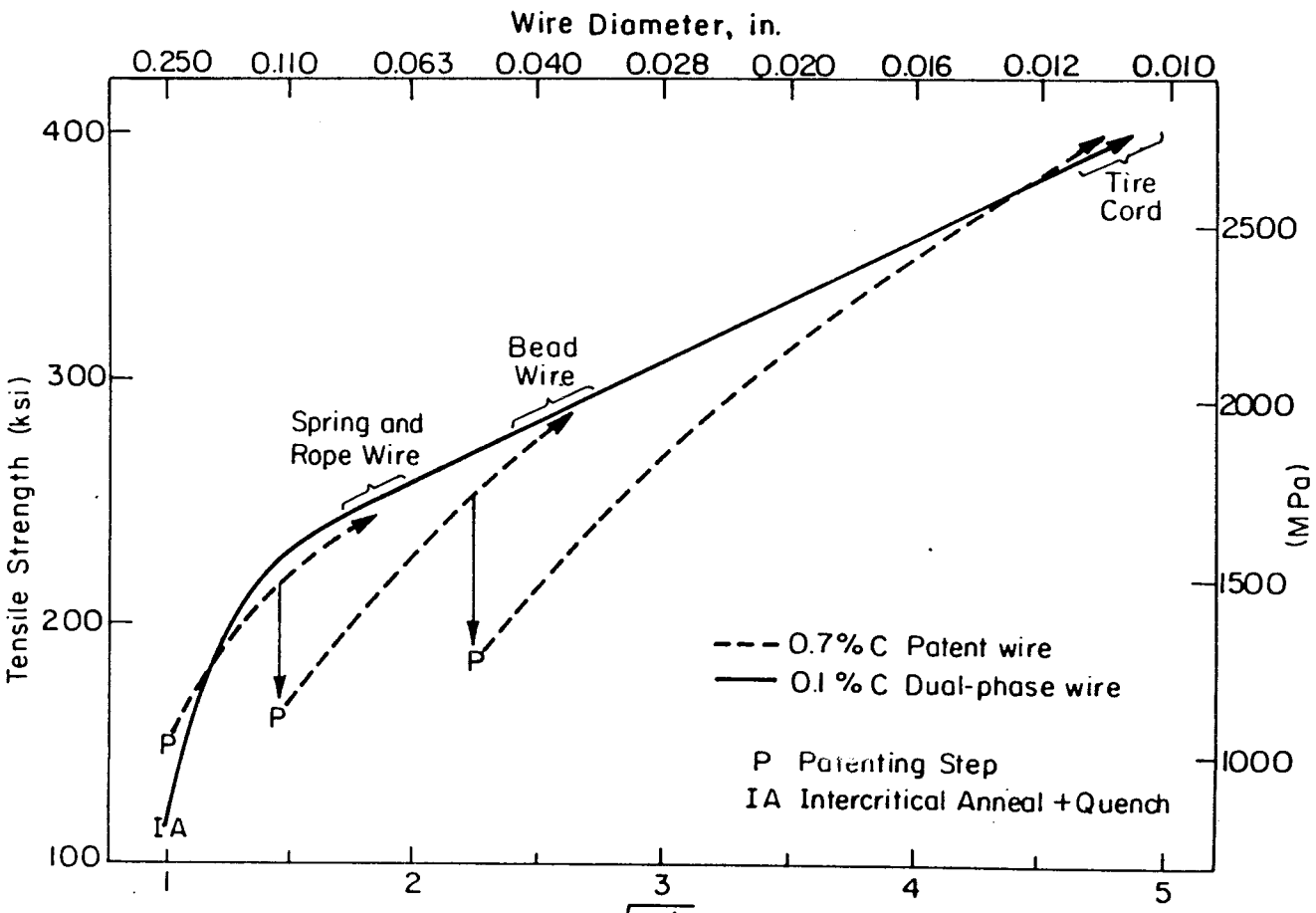
FIG. 3 is a graph exemplifying a typical comparison between a cold drawing schedule for duplex microstructure steel wire according to the present invention and a drawing schedule for pearlitic steel wire according to a patenting method.

Referring to FIG. 3, the differences between the process of the present invention and the patenting process are shown. The solid line illustrates the cold drawing schedule of a low carbon duplex steel wire according to the present invention and the tensile strengths which can be achieved at different diameters. The broken lines indicate the drawing schedule of a pearlitic steel wire according to the patenting method, including the intermediate heat treatments. In the drawing of the pearlitic steel wire, the intermediate heat treatments are necessary in order to achieve the greater tensile strength that the process of the present invention can achieve at various diameters. These intermediate heat treatments increase the complexity and expense of the process for making high-strength steel wire. The process according to the present invention does not involve intermediate heat treatments and thus provides a significant improvement over the known process.

The process of the present invention can produce steel wires and rods with a wide range of tensile strength, ductility, and diameter. The final properties of the steel wire or rod at a given diameter are determined by a combination of the initial microstructure, the properties of the starting steel and the amount of subsequent reduction in cross-sectional area during the cold drawing process. Since the microstructure of the steel is easily manipulated through appropriate thermal processing, the properties of the drawn wire can be tailored to match the required specifications of the desired application. The choice of alloying elements such as silicon, aluminum, manganese, and carbide forming elements, such as, molybdenum, niobium, vanadium, and the like, is determined by the microstructure and properties desired. Thus, a wide range of alloys, including many simple and inexpensive alloys, can be used as long as they can be heat treated to the desired dual-phase microstructure.

One preferred duplex microstructure is the ferrite-martensite microstructure. Another preferred microstructure is the duplex ferrite-bainite microstructure. In both caeses, the strong second phase, either martensite or bainite, is dispersed in a soft, ductile ferrite matrix.

In one preferred embodiment of the process of the present invention the starting steel composition consists essentially of iron, from about 0.05 to 0.15 weight % carbon, and from about 1.0 to 3.0 weight % silicon. In another preferred embodiment the starting steel composition consists essentially of iron, from about 0.05 to 0.15 weight percent carbon, from about 1–3 weight percent silicon, and from about 0.05 to 0.15 weight percent vanadium. In both preferred embodiments, the steel composition is thermally treated form a duplex ferrite-martensite microstructure in a fibrous morphology. Briefly, the preferred process comprises the steps of austenitizing the steel composition, quenching the steel composition to transform the austenite to substantially 100% martensite, heating the resulting steel composition to an annealing temperature for a time sufficient to provide the desired ratio of austenite and ferrite, quick quenching the austenite ferrite composition to transform the austenite to martensite, and cold drawing the resulting dual-phase steel which is characterized by a duplex ferrite-martensite microstructure in a fibrous morphology to the desired diameter in a single multipass operation.

More specifically, the starting steel composition is heated to a temperature, $T_1$, above the critical temperature at which austenite forms. The temperature range for $T_1$, is from about 1050° C. to 1170° C. The composition is held at that temperature for a period of time sufficient to substantially and completely austenitize the steel. The resulting composition is quenched in order to transform the austenite to substantially 100% martensite. The composition is then reheated to an annealing temperature, $T_2$, in the two phase ($\alpha+\gamma$) range. The $\alpha+\gamma$ temperature range is from about 800° C. to 1000° C. The composition is held at this temperature for a period of time sufficient to transform the martensitic steel composition to the desired volume ratio of ferrite and austenite. Upon final quenching, the austenite transforms to martensite, resulting in a strong second phase of martensite dispersed in a soft or ductile ferrite matrix.

The steel composition at this point is characterized by a unique microstructure which is a fine, isotropic, acicular martensite in a ductile ferrite matrix. The microstructure results due to the combination of the double heat treatment and the presence of silicon in the above-specified amount. The unique microstructure maximizes the potential ductility of the soft phase ferrite and also fully exploits the strong martensite phase as a load carrying constituent in the duplex microstructure. It is the microstructure as well as the morphology of the steel composition that enables the steel to be cold drawn to the desired wire or rod diameter in a single multipass operation.

Any dual-phase steel may be used in the process of the present invention as long as a duplex microstructure and morphology can be produced having sufficient cold formability to allow reductions in cross-sectional area of up to about 99.9% when the composition is cold drawn. In particular, dual-phase ferrite-martensite steels have a greater continuous yielding behavior, higher ultimate tensile strength, and better ductility than commercial high strength low alloy steels, including microalloyed, fine-grain steels. Furthermore, the high tensile to yield ratio and high strain hardening rate in ferrite-martensite dual-phase steel provides excellent cold formability.

The exact temperature, $T_1$, to which the steel composition is heated in the first austenization step is not critical as long as it is above the temperature at which complete austenization occurs. The exact temperature, $T_2$, in the second heating step where the composition is transformed to the two phases of ferrite and austenite depends upon the desired volume ratio of ferrite and austenite, which in turn depends upon the desired volume ratio of ferrite-to-martensite. In general, the desired volume ratio of ferrite and martensite depends upon the ultimate properties desired for the steel wire or rod. Generally, the 10–40 volume percent of martensite in the ferrite-martensite microstructure will allow the steel composition to be cold drawn to diameters representing up to 99.9% reductions in cross sectional area and will still result in steel wires and rods having a tensile strength at least about 120 ksi. Usually, tensile strengths in the range of 120 ksi to 390 ksi are obtained, but 400 ksi and above may also be obtained.

The following examples will illustrate the process of the invention more clearly, the resulting properties of the steel wires and rods produced by the process, as well as the flexibility of the process in allowing a choice of alloys, tensile strengths, ductility, and diameters.

EXAMPLE 1

Figure 1:
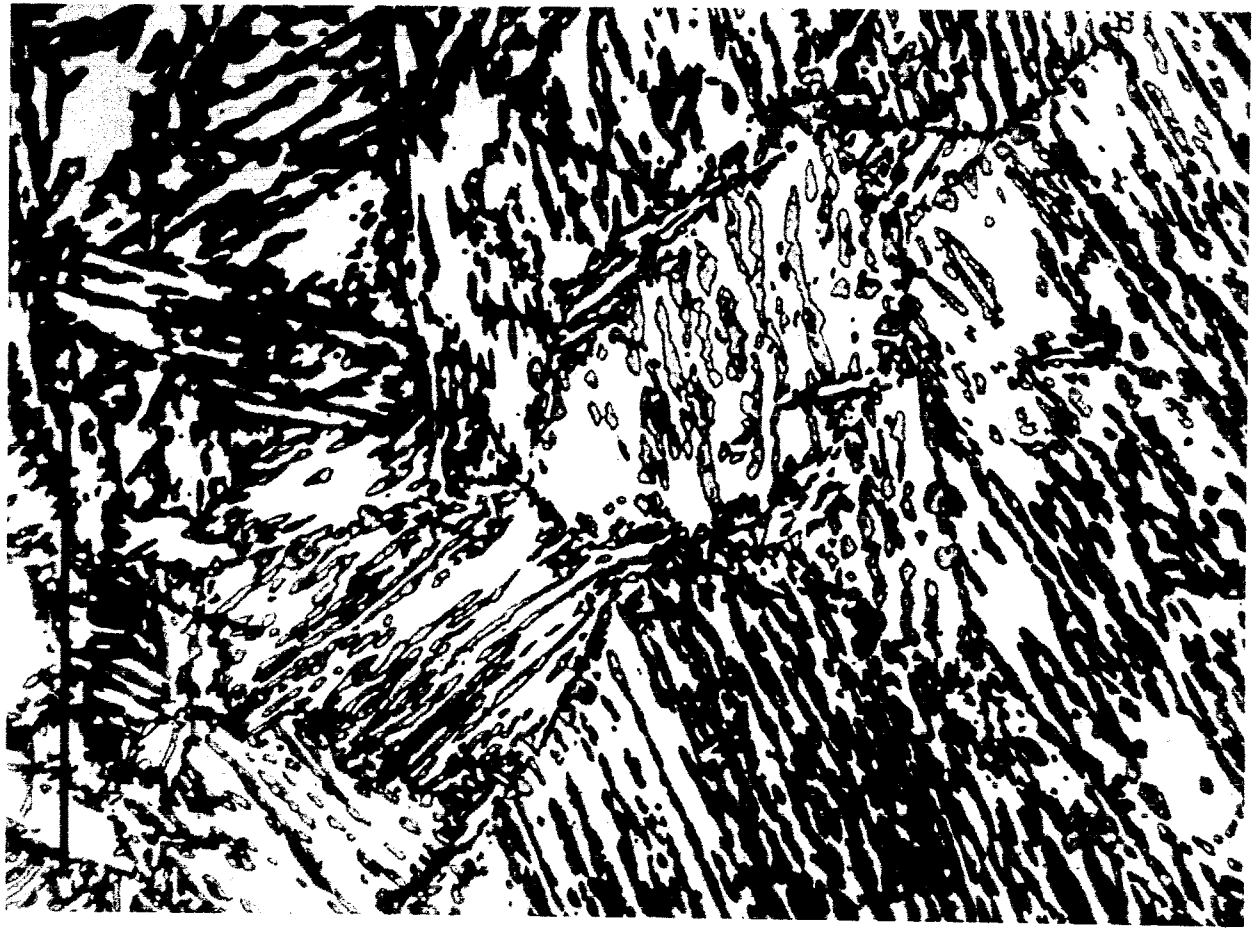
FIG. 1 is an optical micrograph showing a typical low carbon dual-phase ferrite-martensite microstructure prior to cold drawing.
Figure 2:
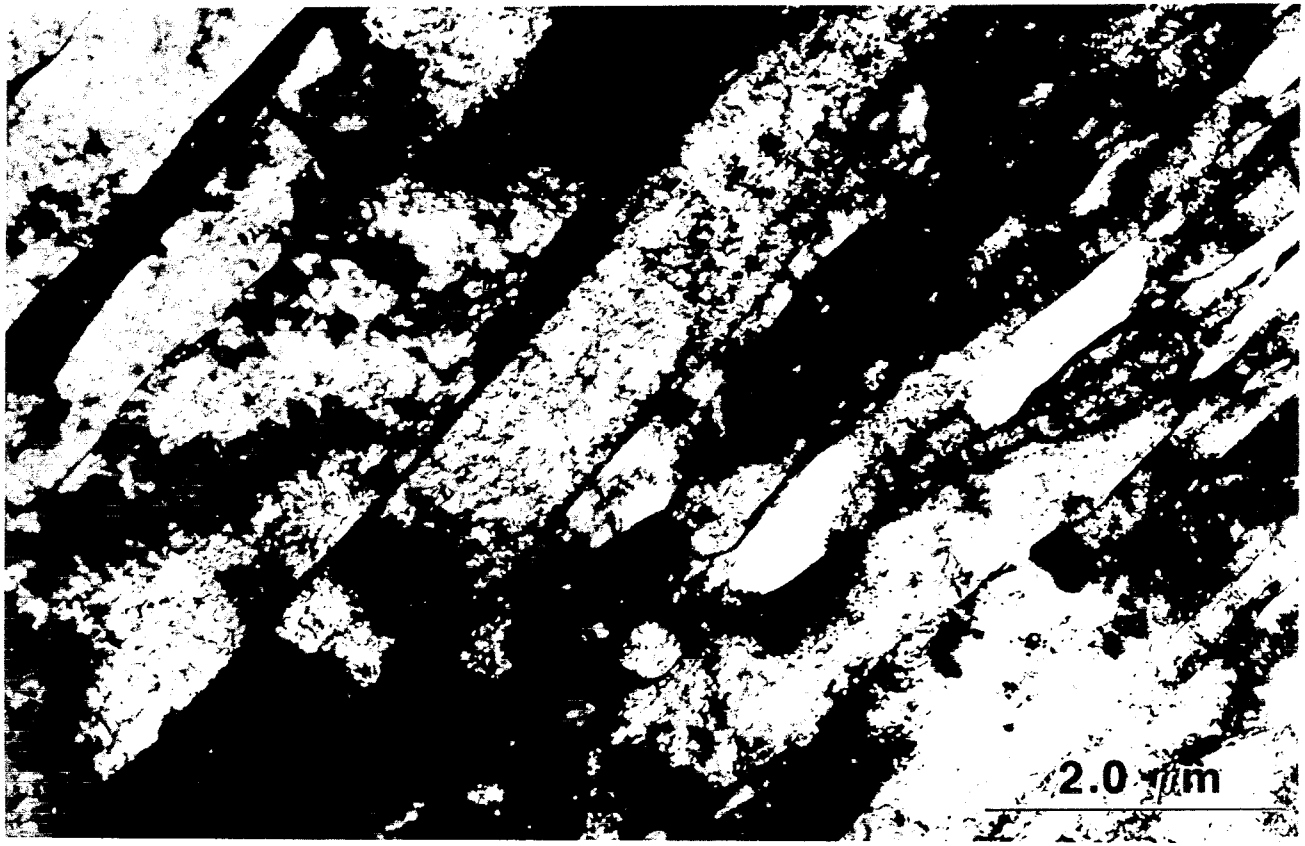
FIG. 2 is a transmission electron micrograph of dislocated lath martensite which comprises the strong second phase in a dual-phase steel according to the present invention.

A high strength, high ductility steel wire was made to satisfy the requirements for bead wire used in the manufacture of automobile tires. The bead wire requires a tensile strength of 270 ksi with 5% elongation, and a proportional limit of 216 ksi. The bead wire should be about 0.037 inch in diameter with sufficient ductility to pass a torsion test requiring 58 axial twists in an 8 inch length. A 0.220 inch diameter steel rod having a composition consisting essentially of iron, 0.1 weight percent carbon, 2 weight percent silicon, and 0.1 weight percent vanadium was austenitized and rapidly quenched to yield a substantially 100% martensitic composition. The rod was then reheated to a temperature of 950° C. in the two phase $\alpha+\gamma$ range and rapidly quenched to produce a duplex ferrite-martensite microstructure of approximately 30 volume percent martensite and 70 volume percent ferrite. The needle-like, acicular character of the ferrite-martensite microstructure is shown in the optical micrograph in FIG. 1. The heat treated rod was then cold drawn through lubricated conical dies down to a diameter of 0.037 inch in 8 passes of approximately 36% reduction in area per pass. After a short stress relief anneal at 425° C. similar to the current practice, an ultimate tensile strength of 276 ksi was achieved, thus satisfying the tensile strength requirement of bead wire. The ductility of the steel wire was sufficient to satisfy the twist test requirement.

EXAMPLE 2

A steel rod consisting essentially of iron, 0.1 weight percent carbon, and 2.0 weight percent silicon was hot rolled to a diameter of 0.25 inch. The rod was then heated to a temperature of about 1150° C. for about 30 minutes to austenitize the composition. The steel was then quenched in iced brine to transfom the austenite to substantially 100% martensite. The rod was then rapidly reheated to a temperature of 950° C. in order to convert the structure to qpproximately 70% ferrite and 30% austenite. The steel rod was then quenched in iced brine to convert the austenite to martensite. Finally, the rod was cold drawn to a diameter of 0.030 inch where its tensile strength was 357 ksi, and also drawn to a diameter of 0.024 inch where its tensile strength was 360 ksi. Continued cold drawing may achieve tensile strengths to 400 ksi or higher.

What is claimed is:

1. A process for making high strength, high ductility steel wire and rods comprising the steps of:

heating a steel composition consisting essentially of iron, from about 0.05 to 0.15 wt. % carbon, and from about 1.0 to 3.0 wt. % silicon to a temperature $T_1$ for a period of time sufficient to substantially completely austenitized said steel;

quenching the resulting austenitized steel composition to transform said austenite to 100% martensite;

heating the resulting martensitic steel composition to a temperature $T_2$ in the two phase $\alpha+\gamma$ range for a period of time sufficient to transform said martensitic steel composition to a volume ratio of ferrite and austenite such that subsequent quenching results in a microstructure having about 10 to 40 volume percent martensite and about 60 to 90 volume percent ferrite;

quenching the resulting ferrite-autenite steel composition to transform the austenite to martensite; and cold drawing the resulting steel composition, said steel composition characterized by a duplex ferrite-martensite microstructure having about 10 to 40 volume percent martensite and about 60 to 90 volume percent ferrite, said microstructure imparting to said steel composition cold formability properties permitting said steel composition to be cold drawn to a diameter representing up to about a 99.9% reduction in cross-sectional area and imparting to the resulting cold drawn steel product tensile strength properties of up to 400 ksi.

2. A process according to claim 1 wherein the cold drawing step is accomplished in a single multipass.

3. A process according to claim 1 wherein said steel composition consists essentially of iron, about 0.1 wt. % carbon, and about 2 wt. % silicon.

4. A process according to claim 1 wherein said steel composition contains from about 0.05 to 0.15 wt. % vanadium.

5. A process according to claim 4 wherein said vanadium content is about 0.1 wt. percent.

6. A process according to claim 1 or 4 wherein $T_1$ is in the range from about 1050° C. to 1170° C. and $T_2$ is in the range from about 800° C. to 1000° C.

7. A process according to claim 1 or 4 wherein $T_1$ is about 1150° C.

8. A process according to claim 1 or 4 wherein $T_2$ is about 950° C. and the resulting microstructure contains about 30 volume percent martensite.

9. A high strength, high ductility, low carbon steel product produced by the process of claim 7.

10. A steel product according to claim 9 wherein said product is steel wire.

11. A steel product according to claim 9 wherein said product is steel bar or rod.

12. A high strength, high ductility, low carbon steel product according to claim 10 or 11 wherein said carbon content is about 0.1 wt. %, said silicon content is about 2 wt. %, said duplex ferrite-martensite microstructure comprises about 30 volume percent martensite, and said tensile strength is from about 357 ksi to about 360 ksi after about 99.9% reduction in cross-sectional area.

13. A high strength, high ductilty, low carbon steel product according to claim 10 or 11 wherein the steel composition contains from about 0.05 to 0.15 wt. % vanadium.

14. A high strength, high ductility, low carbon steel product according to claim 13 wherein said carbon content is about 0.1 wt. %, said silicon content is about 2.0 wt. %, said vanadium content is about 0.1 wt. %, said duplex ferrite-martensite microstructure comprises 30 volume percent martensite, and said tensile strength is about 276 ksi after about 97% reduction in cross-sectional area.

* * * * *